United States Patent [19]

Kesselman

[11] Patent Number: 4,699,408

[45] Date of Patent: Oct. 13, 1987

[54] TAMPER DETERRENT ASSEMBLY

[76] Inventor: David A. Kesselman, 5494 Winter Creek Rd., Santa Rosa, Calif. 95404

[21] Appl. No.: 773,079

[22] Filed: Sep. 6, 1985

[51] Int. Cl.[4] ..... E05C 19/18

[52] U.S. Cl. ..... 292/307 R; 292/329; 292/327; 70/159

[58] Field of Search ..... 292/307, 327, DIG. 11, 292/329; 70/159, 158

[56] References Cited

U.S. PATENT DOCUMENTS

| | | | |
|---|---|---|---|
| 327,783 | 10/1885 | Foote . | |
| 2,003,755 | 6/1935 | Moore . | |
| 4,008,914 | 2/1977 | Anderson . | |
| 4,049,313 | 9/1977 | Lundberg | 292/307 R |
| 4,062,090 | 12/1977 | Moolenaars . | |
| 4,106,801 | 8/1978 | De Lima Castro Neto . | |
| 4,107,959 | 8/1978 | Skarzynski et al. . | |
| 4,112,990 | 4/1978 | Anderson . | |
| 4,254,647 | 3/1981 | Finck | 292/DIG. 11 |
| 4,262,946 | 4/1981 | Swisher | 292/307 R |
| 4,416,478 | 11/1983 | Canney . | |

FOREIGN PATENT DOCUMENTS

| | | | |
|---|---|---|---|
| 176176 | 2/1953 | Austria | 292/307 R |
| 560557 | 7/1958 | Canada | 292/307 R |
| 301440 | 10/1917 | Fed. Rep. of Germany | 292/307 R |
| 2051942 | 1/1981 | United Kingdom | 292/307 R |

*Primary Examiner*—Henry E. Raduazo

*Attorney, Agent, or Firm*—Sixbey, Friedman & Leedom

[57] ABSTRACT

A tamper deterrent assembly is provided for locking a unit having an outer wall which defines an open ended receiving space and which includes opposed openings. A closure unit formed of frangible material is dimensioned to close the open end of the receiving space and is provided with a locking strip engaging section which projects from one surface thereof. A locking strip of material which is more flexible than that forming the closure unit extends through the opposed openings and engages the locking strip engaging section.

35 Claims, 17 Drawing Figures

TAMPER DETERRENT ASSEMBLY

TECHNICAL FIELD

The present invention relates to tamper deterrent seals of the type usable on electric, gas and water meters, cabinets, bag, pouches and the like. In particular, the invention is directed to a new and improved assembly which will not only deter unauthorized opening of a locked enclosure, but will also provide a visual indication of actual or attempted unauthorized access to the enclosure.

BACKGROUND ART

All locking devices are subject to tampering, possibly resulting from loss of keys, duplication of keys, picking etc. Furthermore, in many instances, if visible signs of tampering do not exist, the fact that tampering has occurred may go unnoticed indefinitely. For example, utility meters are normally readable without access to the interior of the meter case so that, if tampering with the meter is unnoticeable, the fact that the meter case has been opened may go undiscovered. This is particularly true when barrel locks of the type conventionally used on meter boxes are improperly opened to expose the meter to tampering. At present, tamper protection for barrel locks involves periodically replacing the barrel lock mechanism, a solution which is both expensive and ineffective. Barrel locks, and other locks exposed to the environment, can become contaminated and problems with the proper functioning of the lock can occur, resulting in the need for the lock to be replaced. Similar problems can occur with respect to cash bags, mail pouches, computer cabinets, cable TV hookups and other secured enclosures that are situated in locations that are accessible to unauthorized persons. Thus, there is a need for a device which will not only provide a tamper deterrent seal for secured enclosures, but will also provide visible evidence of tampering. Secondarily, for lock arrangements that are exposed to the weather, a need exists for such a tamper deterrent seal that will, additionally, provide some weather protection for the lock mechanism.

Skarzynski et al U.S. Pat. No. 4,107,959 discloses a meter box guard lock wherein the box is locked through the use of a conventional barrel lock which is inserted into its locking position through a locking tube. In order to protect the lock from dirt and the weather, a plastic plug is inserted into the top end of the locking tube after the barrel lock has been secured in place. Furthermore, in order to deter tampering and efforts to pick the barrel lock, a conventional wire seal is threaded through a pair of diametrically opposite slots in the upper end of the locking tube and through a corresponding slot formed in the plastic plug. While this seal arrangement achieves some weather-proofing of the barrel lock, such an arrangement actually contributes to the possibility that tampering may be hidden. The wire seal can be shifted so as to enable the wire to be cut, and then the cut portion can be hidden within the slot of the plastic plug after tampering has been carried out and the meter box relocked and resealed.

In the Canney U.S. Pat. No. 4,416,578, a tamper deterrent seal providing an indication of tampering for watt hour meters is disclosed that provides a visual indication when an unauthorized attempt has been made to access the meter. That is, tampering will be visible because of the fact that the seal is constructed of a frangible material and has a head that is designed to readily fragment when placed under stress. While such a seal will provide adequate evidence of tampering, the construction disclosed by Canney requires that the meter box be specifically constructed for use with the tamper deterrent seal of that patent. Moreover, since this tamper deterrent seal of the Canney patent is a seal between housing components of the meter box, and not a seal disposed over the meter lock, itself, it can serve no weather proofing function for the lock.

Although various other forms of protection for utility meters, such as padlock seals, lead and wire seals, dust caps, etc. exist on the market, all are either easily compromised and leave less than an adequate evidence of tampering, require a special construction for the meter box itself and/or fail to provide weather-proofing for the lock.

In another environment, Anderson U.S. Pat. Nos. 4,112,990 and 4,008,914, as well as Moolenaars U.S. Pat. No. 4,062,090, all show reusable pouches having a zipper type closure and a sealing device for maintaining the zipper closed by holding the pull tab of the zipper in the position in which the zipper is closed. The seals of these patents include two parts, an expendable part and a reusable part mounted on the pouch. The expendable part is a button-like closure part that is engageable with the pouch-mounted reusable part and may only be removed from sealing engagement therewith by being broken, deformed or otherwise damaged so as not to be reusable. However, such pouch sealing arrangements require that the pouch be specifically manufactured with the reusable part of the seal as a part thereof, and this reusable part must have a complicated shape that is relatively costly to mold. Still further, since the portion of the button-like expendable part is hidden from normal inspection, it is possible to resecure a damaged button-like part (with something as simple as chewing gum) so that the fact that tampering has occurred will not be noticed until the pouch is re-opened. Alternatively, there is also the possibility that another, like, expendable button-like part might be utilized to reseal the pouch, if the tampering party has access to the same, since there is no means of determining that such a substitution has been made.

The latter-mentioned deficiency is overcome in the security seal and sealing system of Meadow U.S. Pat. No. 4,106,801 by virtue of the fact that the breakable locking strip thereof is provided with an individual identification number. However, the locking strip of this patent requires that each of the two parts that are being secured together have one of a complex, molded cap and spool part attached thereto, thereby placing inherent limitations on the versatility thereof and significantly increasing the cost associated with use of the sealing system of that patent.

Lastly, padlock type seals, like conventional lead and wire type seals, are well known, and patents such as Foote U.S. Pat. No. 327,783 and Moore U.S. Pat. No. 2,003,753 show examples thereof. The seals of these patents use an elongated metal strip as a shackle, the ends of which are secured within a housing, after having been installed, and are designed such that it is impossible to remove the shackle ends from the housing without mutilation sufficient to indicate that the seal has been tampered with. However, the housing of the Foote patent is expensive to produce because it is formed of metal that must be cast about a pin that is used for securing the two ends of the shackle. Furthermore, fastening of the pin requires use of a punch or press to force the pin into the metal wall forming an opposite side of a slot for receiving the shackle ends. Similarly, even though the Moore patent does not require a punch or press for securement purposes, this seal is also expensive to produce due to the multipartite construction of the housing and the need to incorporate a rotatable member therein that is used to deform an end of the shackle strip after it has been inserted into the housing.

Thus, there is a need for a seal that can be serial numbered, leaves evidence of tampering, cannot be glued or replaced easily, is simple in construction and each to install, while being universal in application and cost-effective. Furthermore, for outside applications, a seal that possesses the preceding characteristics and also affords weather protection for the lock is also desirable.

DISCLOSURE OF THE INVENTION

In accordance with the foregoing, it is an object of the present invention to provide a tamper deterrent assembly which will leave evidence of tampering.

It is a further object of the present invention to provide a tamper deterrent assembly which will be simple to install and versatile in its application.

It is yet another object in accordance with the present invention to provide a tamper deterrent assembly which is simple in construction and cost-effective to produce and use.

Still another object in accordance with the present invention is to provide a tamper deterrent assembly which is capable of being serially numbered.

It is also an object of the present invention to provide a tamper deterrent assembly that may be used so as to shield a lock from the effects of dirt and weather as well as serve as a tamper deterrent.

In accordance with various embodiments of the present invention, the tamper deterrent assembly comprises three interactive components. The first component is a body member having a wall means that circumferentially defines a cylindrical space and which is provided with a pair of diametrically opposed slots extending through the wall means. This body member may be an existing ferrule locking tube forming part of a conventional barrel lock arrangement, or may be a barrel lock seal adapted for retrofitting barrel lock devices that do not have seal adapters. In accordance with further forms of the invention, the body member can be integrated into a padlock type seal assembly or may serve as an end section of a strap seal.

A second component of all embodiments is an elongated locking strip that has a first portion with a transverse cross-sectional size and shape that closely conforms to the perimetric size and shape of the opposed slots of the body member and is long enough to at least span the distance therebetween. Furthermore, in all but one of the disclosed embodiments (wherein the locking strip is designed to enter the slots from the interior of the locking tube), the elongated locking strip has a manually grippable portion for use in inserting the first portion into the closed slots of the wall means. The elongated locking strip may be a separate component or may be integrally connected to the body member so as to form the shackle of a padlock type seal.

The third component of all embodiments is a closure piece that is sized for sealing an open end of the cylindrical space of the body member. In most embodiments, this closure piece is in the form of a button-like closure piece having a perimetric contour of a size and shape that is axially insertable within the receiving space of the body member without providing access between the wall means of the body member and the perimeter of the closure piece. Furthermore, in these embodiments, a tang member projects from a diametrically extending surface of the closure piece and is positioned in a location in alignment with a through-slot in the first portion of the locking strip when the closure piece is inserted into the receiving space of the body member and the first portion of the locking strip is inserted into the opposed slots.

On the other hand, in accordance with other embodiments of the invention, the closure piece may itself be a cap-like member. In one such embodiment, the cap-like member has a pair of diametrically opposed slots corresponding in position and size to those of the body member. Furthermore, this cap-shaped closure member is sized to telescopically fit over the body member and is secured thereon by insertion of the first portion of the elongated locking strip through the opposed slots of both the body member and the cap-shaped closure piece. In another embodiment, the cap-like member has not slots, and the locking strip is secured to it in a manner enabling it to engage the slots of the body member when the cap-like member is in place.

Also common to all of the embodiments is the fact that the body member, the locking strip, and the closure piece are configured relative to each other so as to enable the closure piece, the body member and the locking strip to be interlocked in a manner preventing disengagement of the assembly without visible damage to at least one of the closure piece and the locking strip.

These and further objects, features and advantages of the present invention will become more obvious from the following description when taken in connection with the accompanying drawings which show, for purpose of illustration only, several embodiments in accordance with the present invention.

BEST MODE FOR CARRYING OUT THE INVENTION

Figure 1:
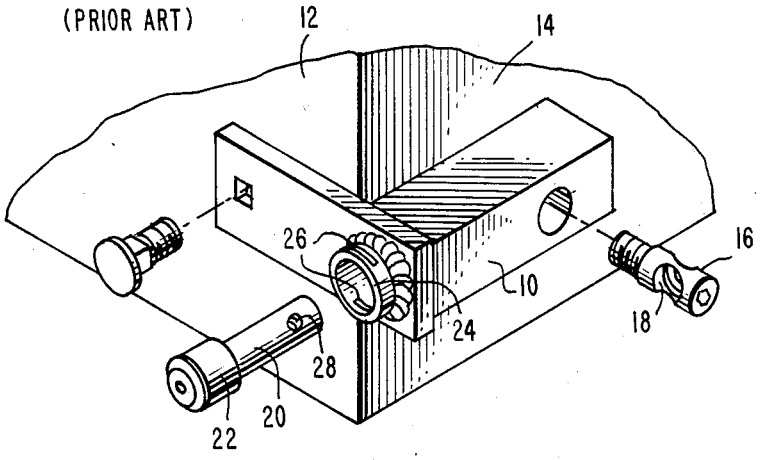
FIG. 1. (PRIOR ART)
FIG. 1 is an exploded perspective view showing a prior art meter lock.

With reference to FIG. 1, a simple meter lock of a known type is illustrated wherein an L-shaped locking member 10 is bolted to the front wall 12 and sidewall 14 of a meter box to prevent opening of the box without the removal of the locking member. To preclude removal of the locking member by unauthorized persons, one bolt 16 which attaches the locking member to the sidewall 14 of the meter box is provided with an opening 18 which receives the shank 20 of a barrel lock 22. The locking member 10, like most conventional meter locks, is provided with a ferrule lock tube 24 which projects outwardly from the locking member and which is provided with opposed slots 26. The barrel lock is inserted into the ferrule lock tube 24 and through the opening 18, and then key operated locking balls 28 on the barrel lock are extended to lock the barrel lock in place.

The meter lock of FIG. 1 is merely illustrative of a wide variety of known meter locks having various configurations, and the operation of this particular meter lock is fully described in U.S. Pat. No. 4,414,829 to A. J. Nielson et al.

The present invention is particularly well adapted for use with barrel locks of the type commonly used for utility meters. In such known locking devices, the barrel lock may be inserted into a cylindrical receiving space of a body member that may be a ferrule lock tube that is part of the lock housing itself, (as shown in FIG. 1), or the ferrule lock tube may be associated only with the head of the barrel lock (see U.S. Pat. Nos. 4,107,959 and 4,080,811). The wall portion of all such known ferrule lock tubes which defines an inlet end of the receiving space in which the barrel lock is inserted is provided with a pair of diametrically opposed slots, similar to the slots 26 in FIG. 1. When the present invention is to be utilized with such conventional locking devices, the ferrule lock tubes of such devices will comprise the first of three main components of the tamper deterrent assembly of the present invention.

Figure 2:
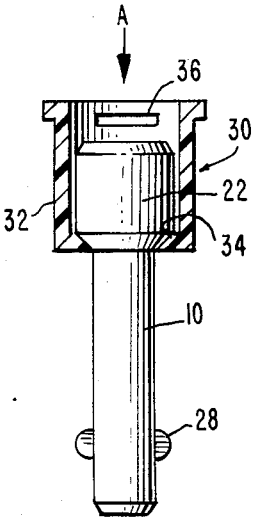
FIG. 2 is a vertical cross-sectional view of an adapter ferrule forming a body member for a tamper deterrent assembly in accordance with the present invention.

On the other hand, for use with barrel lock locking devices that do not have a ferrule locking tube designed for accepting a tamper locking seal, a ferrule lock tube adapter in the form of the body member designated generally by the reference numeral 30, in FIG. 2, may be utilized as a tamper seal adapter for the locking device. Like the ferrule lock tubes of the above-noted conventional devices, that of body member 30 is provided with a wall means 32 that circumferentially defines a cylindrical receiving space. In this regard, the term "cylindrical" is not intended to be restricted to its common usage meaning a right circular cylinder, but rather is intended to encompass any regular or irregular space that is circumferentially bounded by a wall arrangement falling within the broadest meaning of the term cylinder. Thus, the wall means 32 might be rectanguloid, prismatic, etc., as also may be the ferrule lock tubes which are provided with a conventional meter lock.

In use, a barrel lock 22 would be inserted through the receiving space of the body member 30 in the direction of the arrow A (FIG. 2), and the body member would be retained upon the head of the barrel lock by means of an internal, circumferential lip 34 in the manner illustrated. Additionally, like the ferrule lock tubes of the known locking devices, the body member 30 of the FIG. 2 adapter, is provided with a pair of diametrically opposed slots 36 in the wall means 32 adjacent the open, upper end thereof. The adapter may be formed of metal, plastic, or other suitable material.

Figure 3:
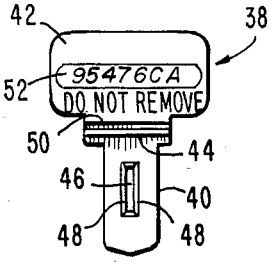
FIG. 3 is a plan view of a locking strip for a tamper deterrent assembly in accordance with the present invention.

The second component of the tamper deterrent assembly of the present invention is a locking strip, such as the elongated, hasp-like locking strip 38 shown in FIG. 3. Locking strip 38 has a shank section 40 of a transverse cross-sectional size and shape that closely conforms to the perimetric size and shape of the slots 36 of the body member 30, as well as of those slots 26 conventionally found on the known locking devices. This enables the shank section 40 to be slidably inserted into the slots with very little clearance existing between the periphery of the shank section and the surrounding wall defining the slot openings. To facilitate insertion of the shank section 40, a second, wider, manually grippable portion 42 is provided. To further ensure that access to the receiving space through the slots 26 or 36 is not obtainable by a thin blade or the like, via the clearance between the shank section of the locking strip 38 and the boundary wall of the slots, the locking strip may be provided with means for blocking access to a first of the slots in the form of a transversely extending ridge 44 spanning the vicinity of the junction between the shank section 40 and the second portion 42 of the locking strip, at each of opposite sides thereof (as shown most clearly in FIG. 5).

The shank section 40 of the locking strip 38 is provided with a longitudinally extending slot which extends therethrough, and preferably the sidewalls 48 of the slot are beveled inwardly toward each other from one surface of the shank section 40 toward the opposite surface. Thus, as illustrated in FIG. 3, the slot 46 is wider adjacent the surface of the shank section illustrated than it is at the opposite surface of the shank section.

A transversely extending score or groove 50 is formed adjacent the ridge 44 so that the enlarged grippable portion 42 will be sure to separate from the shank section 40 when it is pulled or twisted. The portion 42 may be heat stamped with a serial number 52 for a purpose to be subsequently described.

The third component of the assembly of the present invention is a closure piece 54 that, in this embodiment, is in the form of a button-like member having a disc-like portion 56 and a tang member 58. The disc-like portion has a peripheral edge 60 that is closely matched in size to the internal perimeter of the wall 32 of the ferrule lock tube adapter on the opening in a ferrule lock tube 24. Thus, the disc can be inserted into the upper open end of the receiving space of the body member 30 or into the opening in a ferrule lock tube so as to close it in a manner shielding the head of the barrel lock, not only from the effects of weather and dirt, but also in a manner precluding access into the space between the perimeter of the closure piece and the wall of the ferrule lock tube or ferrule lock tube adapter.

Tang member 58 projects centrally from a major face of the disc-like portion 56 and is formed with an enlarged head portion 62 and a stem portion 64. The length of the stem portion is slightly longer than the thickness of the shank section 40 of the locking strip 38, and the maximum perimeter of head portion 62 is designed to be slightly larger than the minimum perimeter of the slot 46 formed in the shank section. Thus, pressure may be applied to the top surface of the disc-like portion 56 so as to force the head portion of tang member 58 through the slot 46 so that it latches onto the area surrounding the slot upon emergence from the slot. In this regard, to facilitate insertion of a head portion 62 that is greater than the perimetric size of the slot 46, the sidewalls 48 are inclined or beveled and the head portion 62 is of a truncated perimetric shape with sidewalls 66 having a slope matched to that of slot sidewalls 48. Also the endwalls 68 of the head portion are beveled. Once the tang is secured through the slot 46, it cannot be removed without breakage of the closure piece 54.

Figure 5:
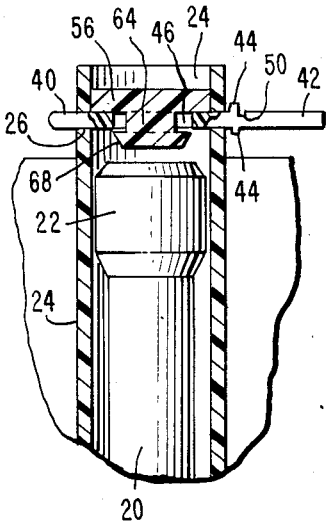
FIG. 5 is a partial sectional view showing the tamper deterrent assembly of the present invention in an installed condition upon a barrel lock of a utility meter box lock.

Additionally, in order to ensure visible evidence of a tampering attempt, it is advantageous that the closure piece 54 be formed of a frangible plastic that will break easily when pried or stressed. Therefore, the shank section 40 of the locking strip 38, and generally the complete locking strip, is formed from a more flexible, non-frangible plastic than is the closure piece so that the through-slot 46 will expand to receive the head portion of the tang member 58 and will then close against the stem portion 64. Once this occurs, the transverse score or groove 50 will result in the manually grippable portion 42 breaking-off if it is twisted or pulled excessively once the closure piece 54 has been interlocked with the locking strip. For While the length of the insertable shank section 40 need only be great enough to span the distance between the pair of opposed slots 26 or 36, (including the depth thereof), it can be significantly longer so as to project from the opposite side of the ferrule lock tube 24 or the body member 30 (relative to the side adjacent which the grippable portion 42 is located) as represented in FIG. 5. Also, the opposing slots 46 are positioned so that the wall of the ferrule lock tube 24 surrounds the disc-like portion 56, and the disc-like portion is recessed relative to the outermost edge at the upper end of the ferrule lock tube when the closure piece 54 is locked in place.

Figure 6:
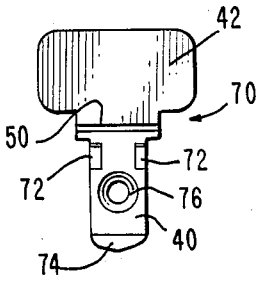
FIG. 6 is a top plan view of a second embodiment of a locking strip in accordance with the present invention.
Figure 7:
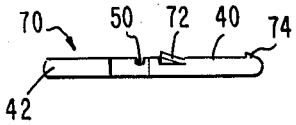
FIG. 7 is a view in side elevation of the locking strip of FIG. 6.

A modified locking strip 70 (FIGS. 6 and 7), includes a shank section 40 which is provided with ramp-like fingers 72 to prevent the locking strip from being retracted once it is fully inserted into its locking position. These fingers compress and pass through one of the slots 26 or 36 with the shank section 40, and then spring up to engage the inner surface of either the ferrule lock tube 24 or the adapter 30. Also, the digital end of the shank section 40, (that opposite the manually grippable portion 42) may be provided with a wedge-like ramp 74 which will function similarly to the ridge 44 for preventing access by a thin knife or probe through the slot once the locking strip is inserted into its locking position (i.e., the position shown in FIG. 5). The locking strip 70 of FIGS. 6 and 7 also includes a modified, circular through-hole 76 in place of the slot 46, which would receive a tang member (not shown) of a truncated conic shape. The hole 76 extends through the shank section 40, and has tapering sidewalls 76 so that the circular through-hole 76 in place of the slot 46, which would receive a tang member (not shown) of a truncated conic shape. The hole 76 extends through the shank section 40, and has tapering sidewalls 76 so that the opening on one side of the shank section has a greater circumference than the opening on the opposite side of the shank section.

FIG. 2 illustrates an additional security aspect in accordance with the present invention in that the grippable portion 42 may be provided with a heat stampable section upon which the serial number 52 may be formed. In order to prevent removal and replacement of a closure piece 54 with another one, the closure piece would be heat stamped with a serial number or a continuation of numbers or letters that would correspond and be recorded with the locking strip serial number. Such serial marking makes the two units secure. Furthermore, color coding may also be used, and increased security can be achieved by manufacturing the parts of non-gluable plastic to ensure that a broken part is not reattached in a manner acting to conceal the fact that tampering has occurred.

Figure 8:
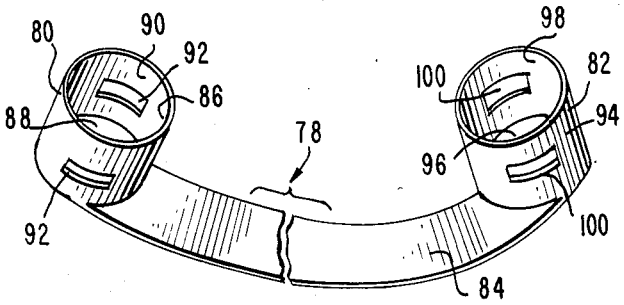
FIG. 8 is a perspective view of a second embodiment of the tamper deterrent assembly in accordance with the present invention.
Figure 9:
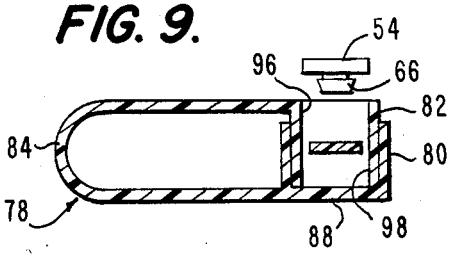
FIG. 9 is a partially exploded, partially cross-sectional side view of the tamper deterrent assembly of FIG. 8 in a condition wherein the locking strip has been inserted, but prior to locking of the closure piece.

Turning now to FIGS. 8 and 9, a strap type seal 78 in accordance with the present invention will be described. In this regard, parts which are identical to parts described relative to FIGS. 1–7 bear like reference numerals. Strap seals are a known type of seal and are used by passing a strap portion thereof through the structure to be sealed before the ends of the strap are joined together. The strap seal of the present invention is intended to function in such manner, and utilizes the concepts of the present invention for achieving a tamper deterrent strap seal which will provide a visible indication of tampering.

In particular, the strap seal 78 of the present invention utilizes a closure piece 54 and a locking strip 38 or 70 identical to those described above. The strap seal 78 includes a pair of body members 80 and 82 which are interconnected by a strap 84 secured thereto. The body members are illustrated as having a cylindrical configuration, but they can be of any configuration which will permit the body member 82 to be inserted into the body member 80 in the manner to be described.

Body member 80 includes a cylindrical sidewall 86 which defines a first end closed by an endwall 88 and a second open end 90. Opposed slots 92 are formed in the sidewall 86 in the same orientation as the slots 26 and 36 previously described.

At an end of the strap 84 opposite to the body member 80, the body member 82 is formed with a cylindrical sidewall 94 of a diameter which will permit the sidewall 94 to telescope within the sidewall 86. The sidewall 94 defines two open ends 96 and 98, and is provided with opposed slots 100 which align with the slots 92 when the body member 82 is telescoped within the body member 80 as shown in FIG. 9.

Once the strap 84 has been wrapped around or inserted through the structure being sealed, the body members 80 and 82 are placed into their FIG. 9 configuration by inserting the open end 98 of the body member 82 with the open end 90 of the body member 80. When the slots 92 and 100 are aligned, a locking strip 38 or 70 is inserted into both sets of slots. Thereafter, the closure piece 54 is snapped into place to interlock the body members, locking strip and closure piece in a manner analogous to that illustrated in FIG. 5.

The strap seal of FIGS. 8 and 9 is preferably molded out of a tough, abrasion-resistant, non-gluable material. All aspects noted with regard to the locking pieces of FIGS. 2 and 6 or the closure piece of FIGS. 3 and 5 would apply to these members as used in this embodiment.

Figure 10:
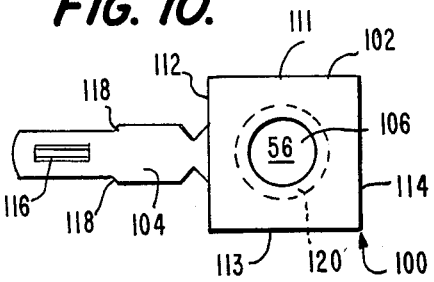
FIG. 10 is a top plan view of a third embodiment of the tamper deterrent assembly of the present invention.
Figure 11:
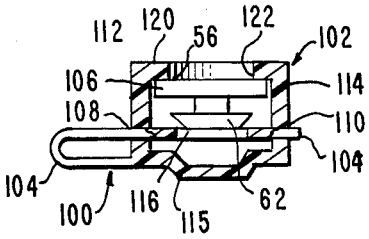
FIG. 11 is a cross-sectional view of the tamper deterrent assembly of FIG. 10 in a position with the locking strip inserted, but prior to securement of the closure piece.

FIGS. 10 and 11 illustrate a form of padlock type seal embodying the concepts of the present invention. As with all of the previously described embodiments, this padlock seal embodiment, designated generally by the reference numeral 100, has three basic components, a body member 102 having wall means defining a cylindrical receiving space, a locking strip 104, and a closure piece 106. However, in the case of this embodiment, the locking strip 104 is integrally joined with the body member 102, similar to the strap 84 with respect to the body members 80 and 82 of the FIGS. 8, 9 embodiment, but only at one end, with an opposite end being left free. The free end of locking strip 104 is receivable in slots 108 and 110 formed in opposite walls 112 and 114 of the body member 102. To ensure proper positioning of a locking strip 104 in the locking slots 108 and 110 optional shoulders 118 may be provided which engage the wall 112 on either side of the slot 110. Alternatively, particularly for use on wires as a sealing cable tie, optional ratchet teeth may also be provided, in which case, no shoulders 118 should be formed on the locking strip.

Figure 4:
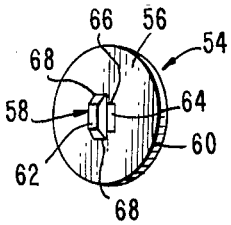
FIG. 4 is a bottom perspective view of a button-like closure piece forming part of a tamper deterrent assembly in accordance with the present invention.

Closure piece 106 is a button-like member identical to the closure piece 54 of FIG. 4, and therefore structural members thereof which are identical to those in FIG. 4 will bear like reference numerals. While this closure piece may be a separate part, preferably it is retained within the body member 102. For example, as illustrated in FIGS. 10 and 11, the sidewalls 111, 112, 113 and 114, which, with a bottom wall 115 form the enclosed body member 102, may include an inwardly extending rim 120 at the uppermost extremity thereof which defines an opening 122 in the body member 102. This rim retains the closure piece 106, but permits access to the disc-like portion 56 thereof so that pressure applied to the closure piece will lock the locking strip into place within the body member 102 when the locking strip is positioned in the manner illustrated in FIG. 11. The head 62 of the closure piece will move downwardly through the locking slot 116 to retain the locking strip 104 within the body member 102. Obviously, the rim 120 could be eliminated and the closure piece 106 would operate as a piece separate from the body member 102, but this is not as convenient as retaining the closure piece within the body member.

Figure 12:
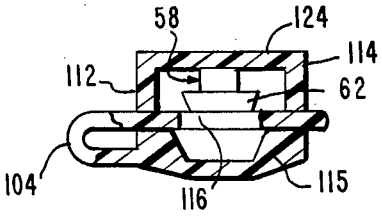
FIG. 12 is a cross-sectional view of yet a further embodiment of a tamper deterrent assembly in accordance with the present invention.

FIG. 12 shows a modification of the padlock seal 100 of FIGS. 10 and 11 wherein the disc-like portion 56 of the closure piece 102 is eliminated and the tang member 58 is formed on a topwall 124 of the body member 102. Topwall 124, with the bottom wall 115 and the sidewalls 111, 112, 113 and 114 provides a completely enclosed body member 102. The topwall 124 is formed of flexible plastic or similar flexible material so that pressure applied to the center portion thereof will cause the head 62 of the tang 58 to pass through the locking slot 116 in the locking strip 104 when the locking strip is positioned as shown in FIG. 12.

Figure 13:
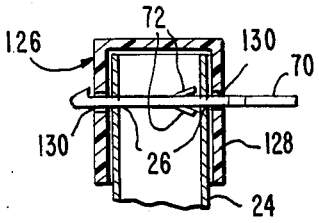
FIG. 13 is a cross-sectional view of a fifth embodiment of the tamper deterrent assembly of the present invention.
Figure 14:
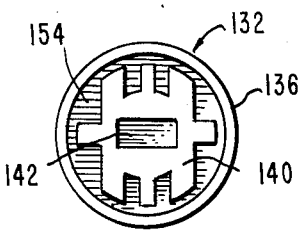
FIG. 14 is a plan view of the button of a closure piece for a sixth embodiment of the tamper deterrent assembly of the present invention.
Figure 15:
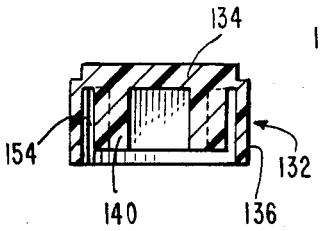
FIG. 15 is a cross-sectional view of the closure piece of FIG. 14.

In FIG. 13, an embodiment of the present invention utilizing a modified form of closure piece is disclosed. In this embodiment, the closure piece of the previous embodiments is replaced by a modified closure piece 126 formed as a cap-shaped member sized to be telescopically mounted upon the ferrule lock tube 24 of a conventional barrel lock of the type shown in FIG. 5. The circumferential wall 128 of the closure piece 124 is provided with a pair of diametrically opposed slots 130 which are configured to match the diametrically opposed seal receiving slots 26 of the ferrule lock tube. In the case of this embodiment, the closure piece has no tang, and interlocking of the three components is achieved through the use of a locking strip 70 of the type shown in FIGS. 6 and 7 (the through-hole 76 being rendered superfluous due to the lack of a tang on the closure piece). The ramp like fingers 72 act to ensure that the locking strip cannot be removed, once inserted. In this embodiment, the fingers extend both above and below the locking strip. The cap-shaped closure piece 124 should be made of a frangible material so as to enable removal of the assembly when necessary to unlock the device, and to show evidence of an attempted unauthorized access.

Figure 16:
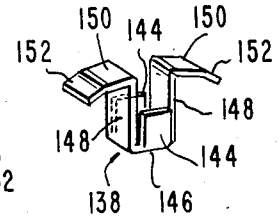
FIG. 16 is a perspective view of a spring metal locking strip for insertion in the closure piece of FIGS. 14 and 15.
Figure 17:
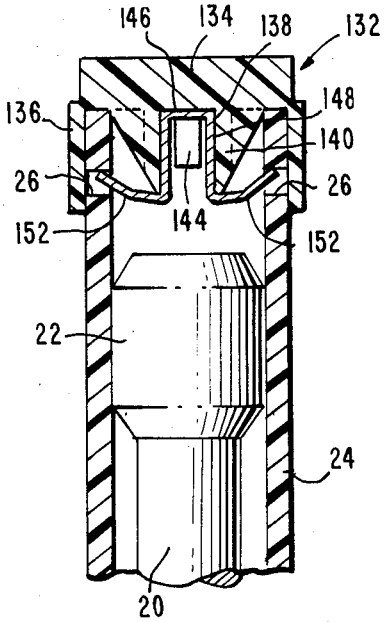
FIG. 17 is a cross-sectional view of the tamper deterrent assembly of FIGS. 14–16 in place in a ferrule lock tube.

FIGS. 14–17 illustrate a last embodiment in accordance with the present invention wherein, like the FIG. 13 embodiment, the closure piece 132 has a cap-shaped design to telescopically fit over the end of a ferrule lock tube 24. However, in the embodiment of FIGS. 14–17 unlike that of FIG. 13, the cap-shaped closure piece is formed with a thick topwall 134 and a thin circumferential wall 136 which will overlap the slots 26 of the ferrule lock tube. There are no corresponding slots in the circumferential wall. Furthermore, in this embodiment, the locking strip 138 is formed of a "U"-shaped member of spring metal and is mounted to the closure piece 132 so as to be carried thereby. For this purpose, the closure piece is provided with an integral locking strip support section 140 which projects inwardly from the topwall 134 in spaced relationship to the circumferential wall 136. This locking strip support section includes a central recess 142, and the locking strip is deformed in its central portion so as to hold itself in the recess 142 under an expansive spring action as shown in FIG. 17. This securing action can be further complimented by forming the locking strip with laterally extending, inclined fingers 144 which wedge themselves against walls of the recess 142 and dig into these walls to prevent removal of the locking strip from the recess. These fingers extend upwardly and are inclined outwardly from the central leg 146 which extends between the spaced legs 148 of the "U"-shaped locking strip.

The locking strip 138 is provided with hook-like wing portions 150 that extend outwardly and then curve angularly downward from the upper extremity of each leg 148 as shown in FIG. 16. When the web 146 and the legs 148 of the locking strip are inserted into the central recess 142, the terminal ends 152 of the wing portions 150 project radially into the space 154 between the circumferential wall 136 and the locking strip support section 140. Then, when the closure piece 132 is pressed down onto the rim of the ferrule locking tube 24, the rim of the ferrule locking tube will displace the hook-like wing portions 150 radially inwardly as it moves into the circumferential space 154. Once the ferrule locking tube is fully inserted into the space 154, the terminal ends 152 of the wing portions 150, when brought into alignment with the diametrically opposed slots 26 of the ferrule locking tube, will spring radially outwardly into the slots, thereby interlocking the closure piece 132 locking strip 138 and ferrule locking tube 24 together as shown in FIG. 17. The closure piece 132 is formed of frangible plastic material which will fracture, should someone try to pry the closure piece off of the ferrule locking tube, thereby providing physical evidence of tampering. The thicker and stronger topwall 134 and locking strip support section 140 ensures that the thinner circumferential wall 136 is the first to fracture.

INDUSTRIAL APPLICABILITY

As can be seen from the foregoing, all of the embodiments of the present invention provide cost-effective, tamper-proof seals that prevent access to a locked enclosure without leaving a visible sign of tampering. Due to the versatility of applicant's assembly that, in all embodiments, is composed of a body member, locking strip, and closure piece, the present invention can be adapted to virtually any environment that calls for the use of tamper seals, such as utility meters, cabinets, cash bags, mail pouches, cable hook-ups, etc.

While I have shown and described various embodiments in accordance with the present invention, it is understood that the same is not limited thereto, but is susceptible of numerous changes and modifications as known to those skilled to the details shown and described herein, but intend to cover all such changes and modifications as are encompassed by the scope of the appended claims.

I claim:

1. A tamper deterrent assembly comprising:

(a) a body member having wall means circumferentially defining a cylindrical receiving space and having diametrically opposed slots extending through said wall means;

(b) an elongated hasp-like locking strip comprising a first portion of a transverse cross-sectional size and shape closely conforming to the perimetric size and shape of said slots and of a length at least equal to the distance between outermost ends of said slots for enablng said first portion to be slidably inserted into said slots and to be supported in both of said slots in a manner precluding access to said receiving space via said slots, said first portion also being provided with an extending through-slot, and said locking strip further comprising a manually grippable second portion for use in inserting said first portion through a first of said slots, across said receiving space and into the other of said diametrically opposed slots; and (c) a button-like closure piece having a perimetric contour of a size and shape that is axially insertable within said receiving space without providing access between said wall means and said perimetric contour, and having a tang member projecting from a diametrically extending surface thereof, said tang member being positioned at a location in alignment with the through-slot of the first portion of the locking strip when the closure piece is inserted into said receiving space and the first portion of the locking strip is inserted into the opposed slots; wherein said body member, locking strip and closure piece are configured relative to each other so as to enable the tang of the closure piece to pass through the through-slot of the locking strip and then interlock therewith in a manner preventing disengagement thereof without visible damage to at least one of said closure piece and said locking strip, said through-slot being bordered by beveled surfaces for facilitating insertion of said tang, the tang being provided with complementarily sloping side walls and having a maximum perimetric length greater than that of said through-slot.

2. A temper deterrent assembly according to claim 1, wherein said body member is a ferrule lock tube for receiving a barrel lock.

3. A tamper deterrent assembly according to claim 2, wherein closure piece is a flat disc of frangible material.

4. A tamper deterrent assembly according to claim 3, wherein said locking strip is provided with breakage means for causing separation of said first portion from said second portion if it is pulled or twisted when the locking strip is within said opposed slots and interlocked with the closure piece.

5. A tamper deterrent assembly according to claim 2, wherein the locking strip is formed with ramp fingers in an area of said first portion which, when the locking strip is inserted into said slots, will be interiorly adjacent said first of the opposed slots, for precluding withdrawal of said locking strip after insertion thereof.

6. A tamper deterrent assembly according to claim 1 wherein said body member is an adaptor for lock assemblies lacking a seal ferrule, said adaptor having lip means extending radially inwardly from said wall means for retaining said adaptor on a head portion of a barrel lock.

7. A tamper deterrent assembly according to claim 1, wherein said locking strip is a generally flat, essentially T-shaped piece, said first portion being formed by a base leg of the T-shape and said second portion being formed by a cross-piece of the T-shape.

8. A tamper deterrent assembly according to claim 1, wherein said locking strip is provided with breakage means for causing separation of said first portion from said second portion if it is pulled or twisted when the locking strip is within said opposed slots and interlocked with the closure piece.

9. A tamper deterrent assembly according to claim 1, wherein said locking strip is provided with means for blocking access to at least one of said slots.

10. A tamper deterrent assembly according to claim 9, wherein the means for blocking comprises a ridge formation on an end of said first portion that is received in a one of said slots of the body member that is located on an opposite side thereof from said second portion.

11. A tamper deterrent assembly according to claim 1, wherein the locking strip is flexible and an end of the second portion of said locking strip that is opposite said first portion is fixed to said body member.

12. A tamper deterrent assembly according to claim 11, wherein said closure piece is initially secured at its periphery to an end of said wall means by a frangible connection in a position partially received within said receiving space, whereby pressure applied to said closure piece, when said first portion of the locking piece is inserted in said slots, will rupture the frangible connection and result in interengagement of said tang with said through-slot.

13. A tamper deterrent assembly according to claim 11 wherein said body member is open at one end, said body member having bottom wall means secured to said wall means to close the end of said body member which is opposite to the open end thereof, and said closure piece being retained by said wall means to close the open end of said body member, said closure piece being movable axially of said body member away from the open end thereof and into said receiving space.

14. A tamper deterrent assembly according to claim 13 wherein said closure piece is formed of frangible material and said locking strip is formed of material which is more flexible and less frangible than the material forming said closure piece.

15. A tamper deterrent assembly according to claim 13 wherein said tang member includes an end section having a terminal end with side walls sloping outwardly therefrom and a stem section extending between said end section and said diametrically extending surface of said closure piece, said end section having a cross-sectional dimension which is greater than that of said stem section at the point of joinder therebetween, the stem section projecting from said diametrically extending surface of said closure piece for a distance sufficient to permit said stem section, when inserted in said through-slot, to extend completely therethrough.

16. A tamper deterrent assembly according to claim 13, wherein said locking strip is provided with means for blocking access to at least one of said slots.

17. A tamper deterrent assembly according to claim 16, wherein the means for blocking comprises a transversely extending ridge spanning the vicinity of a junction between the first and second portions of the locking strip at each side thereof.

18. A tamper deterrent assembly according to claim 1 wherein said body member is open at both ends and secured by a strip to a receiving member that is provided with wall means defining a cylindrical receiving space that is closed at one end and sized for telescopingly receiving said body member, and having a pair of diametrically opposed slots matched to those of said body member, said first portion of said locking strip being of a length at least sufficient to extend between the slots of the receiving member.

19. A tamper deterrent assembly comprising:

(a) a body member having wall means defining a receiving space, said wall means operating to provide a body side wall which extends completely around the perimeter of said receiving space and which includes continuous upper and lower edges, said side wall including first and second strip receiving means formed therein in opposed relationship and spaced from said upper and lower edges, at least said first strip receiving means being formed by a slot which extends through said body sidewall to provide an opening to said receiving space, said slot intersecting neither the upper or lower edges of said sidewall but being spaced therebetween;

(b) an elongated locking strip including a first portion of a length greater than the distance across said receiving space between said first and second strip receiving means, said first portion being formed for insertion into the slot forming said first strip receiving means so as to extend across said receiving space and into said second strip receiving means, said first portion including a terminal end section and a locking section extending from said terminal end section, said second strip receiving means being adapted to receive and support said terminal end section, at least a portion of said locking section having a transverse cross-sectional size and shape closely conforming to the perimetric size and shape of the slot forming said first strip receiving means to prevent access to said receiving space via said slot when said first portion is inserted therethrough and the terminal end section thereof extends into said second strip receiving means, said locking strip further including a second portion connected to and extending from the locking section of said first portion which may be gripped for inserting said first portion through the slot forming said first strip receiving means; and (c) a closure piece having a cap means with a perimetric contour of a size and shape which enables such cap means to move axially relative to said receiving space without providing access between said body sidewall and said cap means, and first locking means projecting from said cap means, said locking section for the first portion of said locking strip including a second locking means which is adapted to interlock with said first locking means in a manner preventing disengagement thereof without visible damage to at least one of said closure piece, locking strip or body member when said first locking means is moved in a path into engagement therewith by movement of said cap means axially relative to said receiving space, said second locking means being positioned to lie in the path of said first locking means when the first portion of said locking strip is inserted through the slot forming said first strip receiving means so as to extend across said receiving space into said second strip receiving means.

20. A tamper deterrent assembly according to claim 19, wherein said locking strip is a generally flat, essentially T-shaped piece, said first portion being formed by a base leg of the T-shape and said second portion being formed by a cross-piece of the T-shape.

21. The tamper deterrent assembly according to claim 19 wherein said closure piece is formed of frangible material and said locking strip is formed of material which is more flexible and less frangible than the material forming said closure piece.

22. The tamper deterrent assembly of claim 19 wherein said closure piece is positioned within the confines of said body member so as not to extend outwardly beyond said body side wall when said first locking means is interlocked with said second locking means.

23. The tamper deterrent assembly according to claim 19 wherein said locking strip is provided with means for blocking access to the slot forming said first strip receiving means when said first and second locking means are interlocked.

24. The tamper deterrent assembly of claim 23 wherein said first and second strip receiving means are positioned to cause said locking strip to be inserted into said receiving space along a path substantially perpendicular to the direction of axial movement taken by said cap means and first locking means to cause interlocking of said first and second locking means.

25. A tamper deterrent assembly comprising:

(a) a body member having wall means circumferentially defining a cylindrical receiving space and having diametrically opposed slots extending through said wall means; said body member forming a ferrule lock tube for receiving a barrel lock, said ferrule lock tube forming an adaptor for lock assemblies lacking a seal ferrule and having lip means extending radially inwardly from said wall means for retaining said ferrule lock tube on a head portion of a barrel lock;

(b) an elongated hasp-like locking strip comprising a first portion of a transverse cross-sectional size and shape closely conforming to the perimetric size and shape of said slots and of a length at least equal to the distance between outermost ends of said slots for enabling said first portion to be slidably inserted into said slots and to be supported in both of said slots in a manner precluding access to said receiving space via said slots, said first portion also being provided with an extending through-slot, and said locking strip further comprising a manually grippable second portion for use in inserting said first portion through a first of said slots, across said receiving space and into the other of said diametrically opposed slots; and (c) a button-like closure piece having a perimetric contour of a size and shape that is axially insertable within said receiving space without providing access between said wall means and said perimetric contour, and having a tang member projecting from a diametrically extending surface thereof, said tang member being positioned at a location in alignment with the through-slot of the first portion of the locking strip when the closure piece is inserted into said receiving space and the first portion of the locking strip is inserted into the opposed slots; wherein said body member, locking strip and closure piece are configured relative to each other so as to enable the tang of the closure piece to pass through the through-slot of the locking strip and then interlock therewith in a manner preventing disengagement thereof without visible damage to at least one of said closure piece and said locking strip.

26. A tamper deterrent assembly according to claim 25, wherein said locking strip is a generally flat, essentially T-shaped piece, said first portion being formed by a base leg of the T-shape and said second portion being formed by a cross-piece of the T-shape.

27. A tamper deterrent assembly comprising:

(a) a body member having wall means circumferentially defining a cylindrical receiving space and having diametrically opposed slots extending through said wall means, said body member forming a ferrule lock tube for receiving a barrel lock;

(b) an elongated hasp-like locking strip comprising a first portion of a transverse cross-sectional size and shape closely conforming to the perimetric size and shape of said slots and of a length at least equal to the distance between outermost ends of said slots for enabling said first portion to be slidably inserted into said slots and to be supported in both of said slots in a manner precluding access to said receiving space via said slots, said first portion also being provided with an extending through-slot, and a manually grippable second portion for use in inserting said first portion through a first of said slots, across said receiving space and into the other of said diametrically opposed slots; said locking strip further including means for blocking access to at least one of said slots, said means for blocking access including a transversely extending ridge spanning the vicinity of a junction between the first and second portions of the locking strip at each side thereof; and (c) a button-like closure piece having a perimetric contour of a size and shape that is axially insertable within said receiving space without providing access between said wall means and said perimetric contour, and having a tang member projecting from a diametrically extending surface thereof, said tang member being positioned at a location in alignment with the through-slot of the first portion of the locking strip when the closure piece is inserted into said receiving space and the first portion of the locking strip is inserted into the opposed slots, wherein said body member, locking strip and closure piece are configured relative to each other so as to enable the tang of the closure piece to pass through the through-slot of the locking strip and then interlock therewith in a manner preventing disengagement thereof without visible damage to at least one of said closure piece and said locking strip

28. A tamper deterrent assembly comprising:

(a) a body member having at least one open end and wall means defining a receiving space extending longitudinally along a longitudinal axis within said body member, said wall means including a body sidewall which extends around the perimeter of said receiving space and which includes continuous upper and lower edges, said body sidewall including first and second strip receiving means formed therein in opposed relationship and spaced from said upper and lower edges, at least said first strip receiving means being formed by a slot which extends through said body side wall to provide an opening to said receiving space, said slot intersecting neither the upper or lower edges of said sidewall but being spaced therebetween, (b) a locking strip having at least a first portion of a transverse cross-sectional size and shape closely conforming to the perimetric size and shape of said slot so as to be receivable therein, and being long enough to at least span the distance between said slot and said second strip receiving means, said second strip receiving means being positioned relative to said slot to receive and support said locking strip when said locking strip is inserted through said slot to extend across said receiving space to said second strip receiving means in a direction substantially normal to the longitudinal axis of said receiving space; and (c) a closure piece movable relative to said receiving space from the open end of said body member in the direction of the longitudinal axis of said receiving space, said closure piece including cap means having a perimetric contour of a size and shape to close the open end of said body without providing access between said sidewall and said cap means, and locking means carried by said cap means, said locking means operating when moved into said receiving space and engagement with said locking strip by movement of said cap means axially of said receiving space with said locking strip engaged in said first and second strip receiving means to interlock said body member, locking strip and cap means with said cap means closing the open end of said body.

29. A tamper deterrent assembly according to claim 28 wherein said locking strip includes said first portion and a second portion extending outwardly from said first portion, the second portion having an end remote from said first portion which is fixed to said body member, the wall means of said body member enclosing all of the receiving space but for the open end of said body member, said wall means retaining said closure piece within said receiving space for movement axially into said receiving space and to close the open end of said body member.

30. A tamper deterrent assembly comprising:

(a) a body member having at least one open end and wall means defining a receiving space extending longitudinally along a longitudinal axis within said body member, said wall means including a body sidewall which extends around the perimeter of said receiving space and which includes first and second strip receiving means formed therein in opposed relationship, at least said first strip receiving means being formed by a slot which extends through said body sidewall to provide an opening to said receiving space, (b) a locking strip having at least a first portion of a transverse cross-sectional size and shape closely conforming to the perimetric size and shape of said slot so as to be receivable therein, and being long enough to at least span the distance between said slot and said second strip receiving means, said second strip receiving means being positioned relative to said slot to receive and support said locking strip when said locking strip is inserted through said slot to extend across said receiving space to said second strip receiving means in a direction substantially normal to the longitudinal axis of said receiving space, and said locking strip including means for blocking access to said slot; and (c) a closure piece movable relative to said receiving space from the open end of said body member in the direction of the longitudinal axis of said receiving space, said closure piece including cap means having a perimetric contour of a size and shape to close the open end of said body without providing access between said sidewall and said cap means, and locking means carried by said cap means, said locking means operating when moved into said receiving space and engagement with said locking strip by movement of said cap means axially of said receiving space with said locking strip engaged in said first and second strip receiving means to interlock said body member, locking strip and cap means with said cap means closing the open end of said body, said means included on said locking strip for blocking access to said slot including a transversely extending raised ridge spanning said locking strip so as to lie adjacent to the exterior of the body sidewall when said body member, locking strip and cap means are interlocked by said locking means.

31. A tamper deterrent assembly comprising:

(a) a body member having wall means defining a receiving space, said wall means operating to provide a body side wall which extends completely around the perimeter of said receiving space and which includes first and second strip receiving means formed therein in opposed relationship, at least said first strip receiving means being formed by a slot which extends through said body sidewall to provide an opening to said receiving space:

(b) an elongated locking strip including a first portion of a length greater than the distance across said receiving space between said first and second strip receiving means, said first portion being formed for insertion into the slot forming said first strip receiving means so as to extend across said receiving space and into said second strip receiving means, said first portion including a terminal end section and a locking section extending from said terminal end section, said second strip receiving means being adapted to receive and support said terminal end section, at least a portion of said locking section having a transverse cross-sectional size and shape closely conforming to the perimetric size and shape of the slot forming said first strip receiving means to prevent access to said receiving space via said slot when said first portion is inserted therethrough and the terminal end section thereof extends into said second strip receiving means, said locking strip further including a second portion connected to and extending from the locking section of said first portion which may be gripped for inserting said first portion through the slot forming said first strip receiving means, said locking strip being provided with means for blocking access to the slot forming said first strip receiving means when said first and second locking means are interlocked, said means for blocking access including at least a section of said second portion of said locking strip which is of greater thickness than said first portion to form a raised ridge which abuts the exterior of said sidewall when the terminal end section of said first portion is received by said second strip receiving means; and (c) a closure piece having a cap means with a perimetric contour of a size and shape which enables such cap means to move axially relative to said receiving space without providing access between said body sidewall and said cap means, and first locking means projecting from said cap means, said locking section for the first portion of said locking strip including a second locking means which is adapted to interlock with said first locking means in a manner preventing disengagement thereof without visible damage to at least one of said closure piece, locking strip or body member when said first locking means is moved in a path into engagement therewith by movement of said cap means axially relative to said receiving space, said second locking means being positioned to lie in the path of said first locking means when the first portion of said locking strip is inserted through the slot forming said first strip receiving means so as to extend across said receiving space into said second strip receiving means, said closure piece being formed of frangible material and said locking strip being formed of material which is more flexible and less frangible than the material forming said closure piece.

32. The tamper deterrent assembly of claim 31 wherein said first and second strip receiving means are each formed by a slot which extends through said body sidewall, the slots forming said first and second strip receiving means being diametrically opposed so that said locking strip is insertable into said receiving space along a path substantially perpendicular to the direction of axial movement of said cap means and first locking means to cause interlocking of said first and second locking means.

33. A tamper deterrent assembly comprising:

(a) a body member having wall means defining a receiving space, said wall means operating to provide a body side wall which extends completely around the perimeter of said receiving space and which includes first and second strip receiving means formed therein in opposed relationship, at least said first strip receiving means being formed by a slot which extends through said body sidewall to provide an opening to said receiving space;

(b) an elongated locking strip including a first portion of a length greater than the distance across said receiving space between said first and second strip receiving means, said first portion being formed for insertion into the slot forming said first strip receiving means so as to extend across said receiving space and into said second strip receiving means, said first portion including a terminal end section and a locking section extending from said terminal end section, said second strip receiving means being adapted to receive and support said terminal end section, at least a portion of said locking section having a transverse cross-sectional size and shape closely conforming to the perimetric size and shape of the slot forming said first strip receiving means to prevent access to said receiving space via said slot when said first portion is inserted therethrough and the terminal end section thereof extends into said second strip receiving means, said locking strip further including a second portion connected to and extending from the locking section of said first portion which may be gripped for inserting said first portion through the slot forming said first strip receiving means; and (c) a closure piece having a cap means with a perimetric contour of a size and shape which enables such cap means to move axially relative to said receiving space without providing access between said body sidewall and said cap means, and first locking means projecting from said cap means, said locking section for the first portion of said locking strip including a second locking means which is adapted to interlock with said first locking means in a manner preventing disengagement thereof without visible damage to at least one of said closure piece, locking strip or body member when said first locking means is moved in a path into engagement therewith by movement of said cap means axially relative to said receiving space, said second locking means being formed by a through-slot extending through the locking section of the first portion of said locking strip and positioned to lie in the path of said first locking means when the first portion of said locking strip is inserted through the slot forming said first strip receiving means so as to extend across said receiving space into said second strip receiving means, said first locking means including a tang member projecting from said cap means having a terminal end surface and at last one sidewall which slopes outwardly from said terminal end surface to provide said tang member with a perimetric dimension which is greater than that of said through-slot.

34. The tamper deterrent assembly according to claim 33 wherein said tang member includes an end section which includes said terminal end surface and outwardly sloping sidewall and a stem section extending between said end section and said cap means, said end section having a cross-sectional dimension which is greater than that of said stem section at the point of joinder therebetween, the stem section projecting from said cap means for a distance sufficient to permit said stem section, when inserted in said through-slot, to extend completely therethrough.

35. The tamper deterrent assembly according to claim 34 wherein the end section of said tang member includes at least two opposed sidewalls sloping outwardly from said terminal end surface, said through-slot being bordered by beveled surfaces for facilitating the insertion of said tang member.

* * * * *